US010542824B2

(12) United States Patent
Huang

(10) Patent No.: US 10,542,824 B2
(45) Date of Patent: Jan. 28, 2020

(54) CONVERTIBLE INFLATABLE DEVICE

(71) Applicant: Yi Wei Huang, Shanghai (CN)

(72) Inventor: Yi Wei Huang, Shanghai (CN)

( * ) Notice: Subject to any disclaimer, the term of this patent is extended or adjusted under 35 U.S.C. 154(b) by 599 days.

(21) Appl. No.: 15/222,079

(22) Filed: Jul. 28, 2016

(65) Prior Publication Data

US 2017/0360206 A1 Dec. 21, 2017

(30) Foreign Application Priority Data

Jun. 16, 2016 (CN) ..... 2016 2 0586395 U

(51) Int. Cl.

| | |
|---|---|
| ***A47C 17/04*** | (2006.01) |
| ***A47C 27/08*** | (2006.01) |
| ***A63G 21/18*** | (2006.01) |
| ***B63B 7/08*** | (2006.01) |
| ***E04H 15/20*** | (2006.01) |

(52) U.S. Cl.

CPC ..... *A47C 17/04* (2013.01); *A47C 27/081* (2013.01); *A63G 21/18* (2013.01); *B63B 7/08* (2013.01); *E04H 15/20* (2013.01); *E04H 2015/201* (2013.01); *E04H 2015/204* (2013.01)

(58) Field of Classification Search

CPC .. A47C 17/04; A47C 4/54; A47C 3/16; A47C 527/081; A63G 21/18; A63H 23/10; A63H 33/008; B63B 7/08; E04H 15/20; E04H 2015/201; E04H 2015/204

See application file for complete search history.

(56) References Cited

U.S. PATENT DOCUMENTS

| | | | | |
|---|---|---|---|---|
| 2,623,574 | A * | 12/1952 | Damsch | A47C 1/146 297/1 |
| 6,138,306 | A * | 10/2000 | Muhanna | A61G 1/00 128/870 |
| 6,240,584 | B1 * | 6/2001 | Perez | A47C 27/082 5/710 |
| 9,586,150 | B1 * | 3/2017 | Pamplin | A63G 21/18 |
| 2005/0022715 | A1 * | 2/2005 | Dunn | B63B 7/08 114/345 |
| 2011/0154574 | A1 * | 6/2011 | Hrubant | A47C 27/084 5/706 |

FOREIGN PATENT DOCUMENTS

| | | |
|---|---|---|
| CN | 201920226 U | 8/2011 |

* cited by examiner

*Primary Examiner* — Nicholas F Polito
*Assistant Examiner* — Alexis Felix Lopez
(74) *Attorney, Agent, or Firm* — Muncy, Geissler, Olds & Lowe, P.C.

(57) ABSTRACT

A convertible inflatable device includes a first inflatable bed, a second inflatable bed, a front chamber, a left chamber, a right chamber, and a rear chamber. The first inflatable bed is surrounded by the front chamber, the left chamber, the right chamber, and the rear chamber. The front chamber, the left chamber, the rear chamber, and the right chamber are connected to each other sequentially. A first end of the second inflatable bed is connected to the junction of the first inflatable bed and the rear chamber. The convertible inflatable device can be converted to an inflatable bed, an inflatable boat, an inflatable water slide or an inflatable recliner chair, and the conversion between any of them is mutual and convenient.

9 Claims, 2 Drawing Sheets

CONVERTIBLE INFLATABLE DEVICE

BACKGROUND OF THE INVENTION

1. Field of the Invention

The present invention relates to a convertible inflatable product, and more particularly to a convertible inflatable device.

2. Description of the Prior Art

With the development of recreational inflatable product industry, inflatable products experienced very important increase in types, including inflatable boats, inflatable beds and inflatable water slides etc. They are widely used in many different recreational activities to meet the needs from both adults and children. But all current products have a common defect as they are almost all single-functional ones.

To solve the above-mentioned problem, many existing inflatable products have adopted structural transforming ways, ex. folding an inflatable bed into a recliner chair, or as disclosed in Chinese Patent No. CN2011200647102, tying buckles of a transformable inflatable bed to form a swim ring. However, there are still very limited similar products available in the market to meet the needs of users, especially there are no multi-functional ones existing in the market.

Accordingly, the inventor of the present invention has devoted himself based on his many years of practical experiences to solve these problems.

SUMMARY OF THE INVENTION

The primary object of the present invention is to provide a convertible inflatable device that has a simple structure and is multi and easy transformable.

Another object of the present invention is to provide a convertible inflatable device that can be converted to an inflatable bed, an inflatable boat, an inflatable water slide, an inflatable recliner chair, or an inflatable tent, and the conversion between any of them is mutual and convenient.

In order to achieve the aforesaid objects, the present invention provides a convertible inflatable device. The convertible inflatable device comprises a first inflatable bed, a second inflatable bed, a front chamber, a left chamber, a right chamber, and a rear chamber. The first inflatable bed is surrounded by the front chamber, the left chamber, the right chamber, and the rear chamber. The front chamber, the left chamber, the rear chamber, and the right chamber are connected to each other sequentially.

A first end of the second inflatable bed is connected to the junction of the first inflatable bed and the rear chamber.

The first inflatable bed is welded to form a first inflatable belt, a second inflatable belt, and a third inflatable belt. The first inflatable belt is connected to the front chamber. The third inflatable belt is connected to the rear chamber. The second inflatable belt is located between the first inflatable belt and the third inflatable belt.

The left chamber is welded to form a first chamber, a second chamber, and a third chamber. The right chamber is welded to form a fourth chamber, a fifth chamber, and a sixth chamber. The first chamber and the fourth chamber are located at opposite two sides of the first inflatable belt. The second chamber and the fifth chamber are located at opposite two sides of the second inflatable belt. The third chamber and the is sixth chamber are located at opposite two sides of the third inflatable belt.

In an embodiment, the front chamber, the left chamber, the right chamber, and the rear chamber each have a horizontal height higher than that of the first inflatable bed.

In an embodiment, the first inflatable bed is welded vertically to form a plurality of first tubes, and the first tubes communicate with one another.

The second inflatable bed is welded vertically to form a plurality of second tubes, and the second tubes communicate with one another.

In an embodiment, the convertible inflatable device further comprises a water-spraying hose. The water-spraying hose has a plurality of water-spraying holes thereon. One end of the water-spraying hose is disposed on the first inflatable bed, and the other end of the water-spraying hose is extended beyond a second end of the second inflatable bed.

The water-spraying holes are grouped in two, located on two sides of the water-spraying hose.

The water-spraying hose is centered on the first inflatable bed and the second inflatable bed.

The second end of the second inflatable bed is movably connected to the junction of the first inflatable bed and the front chamber to form an arch.

In an embodiment, an outer side of the front chamber is provided with two third rope holders. The second end of the second inflatable bed is tied with the third rope holders through ropes, enabling the second inflatable bed to form an arch.

In an embodiment, the first end of the second inflatable bed is connected to the junction of the first inflatable bed and the rear chamber through an extension section.

In an embodiment, outer sides of the left chamber and the right chamber are provided with oar holders or fishing rod holders.

In an embodiment, two sides of the second inflatable bed are provided with a plurality of first rope holders used to tie and hang curtains.

In an embodiment, outer sides of the third chamber and the sixth chamber are provided with second rope holders respectively. Outer sides of the second chamber and the fifth chamber are provided with oar holders respectively. The second rope is holder is tied to the oar holder at the same side so as to fold the second inflatable belt and the third inflatable belt towards each other.

An outer side of the front chamber is provided with two third rope holders, and the second end of the second inflatable bed is bent towards the front chamber and tied to the third rope holders through ropes.

According to preferred embodiments, the present invention has the following advantages:

(1) The present invention converts the inflatable bed to an inflatable water slide by lying the second inflatable bed on the ground and spraying water through the holes of the water-spraying hose; converts the inflatable bed to an inflatable boat with a canopy by bending the second inflatable bed to an arch, then further converts it to an inflatable tent by hanging curtains on the inflatable boat; and converts the inflatable bed to an inflatable recliner chair by tying the second rope holders to the oar holders at the same side then folding the second inflatable belt and the third inflatable belt. All conversions are convenient and efficient.

(2) The bent second inflatable bed of the present invention, as is in arch shape, it can block sun shine and resist rain, also has stronger anti-wind and anti-pressure advantages. Finally, compared with other shapes (ex. triangle), the arch shape maximizes the inner space on the boat, as well as the boat's aesthetic values.

(3) Curtains could be hung on both sides of the arch-shaped second inflatable bed of the present invention, creating privacy on boat to facilitate users' needs such as swimwear change etc.

Embodiments of the present invention will now be described, by way of example only, with reference to the accompanying drawings.

DETAILED DESCRIPTION OF THE PREFERRED EMBODIMENTS

Figure 1:
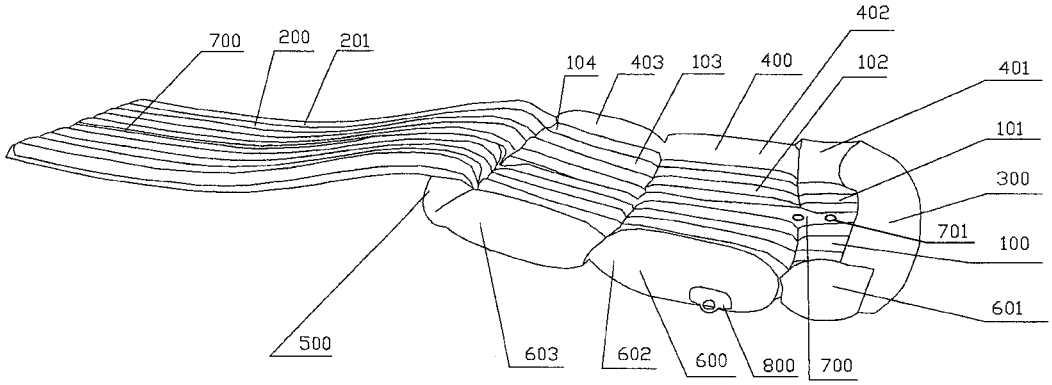
FIG. 1 is a schematic view of the convertible inflatable device of the present invention.

Advantages and features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art.

Referring to FIG. 1 to FIG. 4, a convertible inflatable device according to a preferred embodiment of the present invention can be converted to an inflatable bed, an inflatable boat, an inflatable water slide, or an inflatable recliner chair mutually and conveniently. Specifically, the convertible inflatable device includes a first inflatable bed 100, a second inflatable bed 200, a front chamber 300, a left chamber 400, a right chamber 600, and a rear chamber 500. The first inflatable bed 100 is surrounded by the front chamber 300, the left chamber 400, the right chamber 600, and the rear chamber 500. The front chamber 300, the left chamber 400, the rear chamber 500, and the right chamber 600 are connected to each other sequentially. A first end of the second inflatable bed 200 is connected to the junction of the first inflatable bed 100 and the rear chamber 500.

The first inflatable bed 100 is welded to form a first inflatable belt 101, a second inflatable belt 102, and a third inflatable belt 103. The first inflatable belt 101 is connected to the front chamber 300. The third inflatable belt 103 is connected to the rear chamber 500. The second inflatable belt 102 is located between the first inflatable belt 101 and the third inflatable belt 103.

The left chamber 400 is welded to form a first chamber 401, a second chamber 402, and a third chamber 403. The right chamber 600 is welded to form a fourth chamber 601, a fifth chamber 602, and a sixth chamber 603. The first chamber 401 and the fourth chamber 601 are located at opposite two sides of the first inflatable belt 101. The second chamber 402 and the fifth chamber 602 are located at opposite two sides of the second inflatable belt 102. The third chamber 403 and the sixth chamber 603 are located at opposite two sides of the third inflatable belt 103.

Accordingly, the front chamber 300, the left chamber 400, the right chamber 600, and the rear chamber 500 all have a horizontal height higher than that of the first inflatable bed 100. The front chamber 300, the left chamber 400, the right chamber 600, and the rear chamber 500 all can be used as pillows to expand the useful total area of the inflatable bed, to contain more users and to improve the comfort.

Accordingly, the first inflatable bed 100 is welded vertically to form a plurality of first tubes 104. The first tubes 104 communicate with one another. The second inflatable bed 200 is welded vertically to form a plurality of second tubes 201. The second tubes 201 communicate with one another.

Preferably, the number of the first tubes 104 is same as that of the second tubes 201, as well as the diameter of each tube.

Specifically, the number of the first tubes 104 is ten, the number of the second tubes 201 is ten, and the diameter of each tube is about eleven centimeters.

The aforesaid convertible inflatable device is mainly made of environmentally friendly PVC materials.

Figure 2:
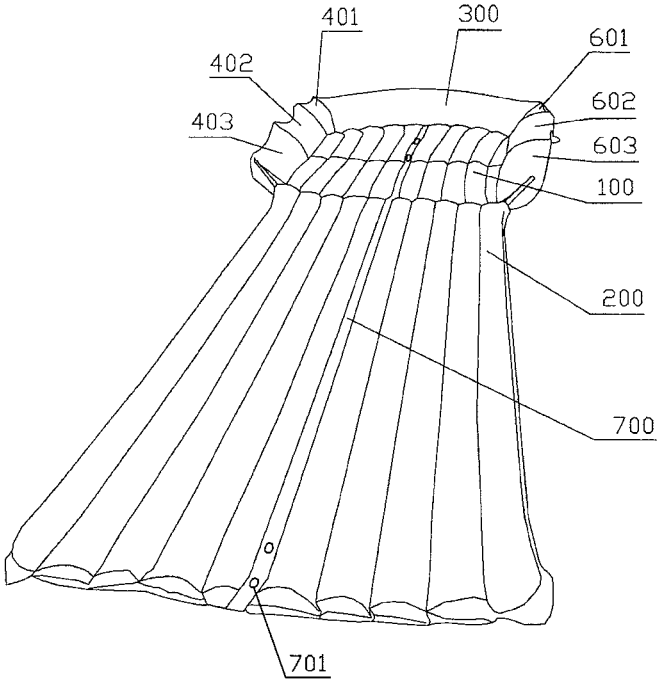
FIG. 2 is a schematic view of the inflatable water slide of the present invention.

As shown in FIG. 1 and FIG. 2, the inflatable water slide includes the first inflatable bed 100, the second inflatable bed 200, the front chamber 300, the left chamber 400, the right chamber 600, the rear chamber 500, and a water-spring hose 700. The first inflatable bed 100 is surrounded by the front chamber 300, the left chamber 400, the right chamber 600, and the rear chamber 500. The front chamber 300, the left chamber 400, the rear chamber 500, and the right chamber 600 are connected to each other sequentially. The first end of the second inflatable bed 200 is connected to the junction of the first inflatable bed 100 and the rear chamber 500. The water-spraying hose 700 has a plurality of water-spraying holes 701 thereon. One end of the water-spraying hose 700 is disposed on the first inflatable bed 100, and the other end of the water-spraying hose 700 is extended onto the second inflatable bed 200.

Preferably, one end of the water-spraying hose 700 is disposed on the first inflatable bed 100, and the other end of the water-spraying hose 700 is extended beyond a second end of the second inflatable bed 200.

Preferably, the water-spraying hose 700 is centered on the first inflatable bed 100 and the second inflatable bed 200, dividing the first inflatable bed 100 and the second inflatable bed 200 into two (left and right) separate sliding ways.

Preferably, the water-spraying holes 701 are grouped in two, located on both left and right sides of the water-spraying hose 700, to spray water and to lubricate both left and right sliding ways.

When the inflatable bed is converted to the inflatable water slide, users only need to deflate the rear chamber 500, lay the second inflatable bed 200 on the ground, fill water into the water-spraying hose 700 to make water spray out of the water-spraying holes.

In practical operations, to form an uninflated water slide: keep the first inflatable bed 100 and the second inflatable bed 200 uninflated, fill water into the water-spraying hose 700 until water sprays out of the water-spraying holes; to form an inflated water slide, inflate the first inflatable bed 100 and the second inflatable bed 200, but keep the rear chamber 500 uninflated, then fill water into the water-spraying hose 700. While the first inflatable bed 100 and the second inflatable bed 200 provide a buffering effect to the water slide, the inflated water slide reduces the ground impact and consequent injuries on users, allowing the water slide to be used on harder surfaces beyond grass and enhancing the usage efficiency.

Based on the same principle, move the above said water slide to the water surface, if inflate the rear chamber 500 (if users don't like water enter into the hull) or keep the rear chamber 500 uninflated (if users like or don't care whether water enter into the hull or not), then inflate the first inflatable bed 100 and the second inflatable bed 200, the inflatable water slide will form an inflatable boat and an inflatable floating island to provide more users to have more recreational experiences (ex. Users can get on/off the floating island to dive and swim as well as sitting in the boat to boat or fish).

Wherein, both the first tubes 104 and the second tubes 201 are in round shape, forming ditches among the tubes. These ditches can guide users and prevent users from deviating the sliding ways. Thus, the aforesaid water slide increases its safety in use.

Figure 3:
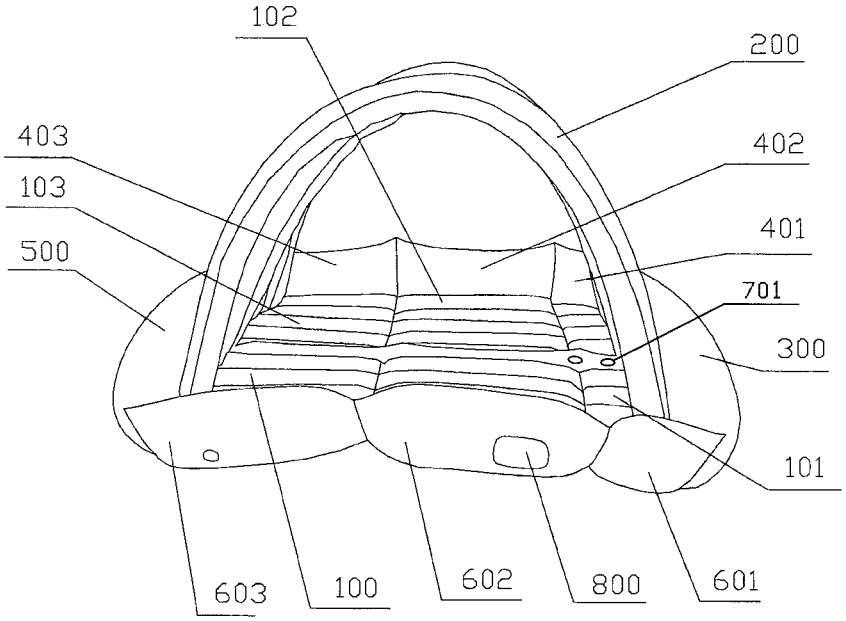
FIG. 3 is a schematic view of the inflatable boat of the present invention.

As shown in FIG. 1 and FIG. 3, the inflatable boat includes the first inflatable bed 100, the second inflatable bed 200, the front chamber 300, the left chamber 400, the right chamber 600, and the rear chamber 500. The first inflatable bed 100 is surrounded by the front chamber 300, the left chamber 400, the right chamber 600, and the rear chamber 500. The front chamber 300, the left chamber 400, the rear chamber 500, and the right chamber 600 are connected to each other sequentially. The first end of the second inflatable bed 200 is connected to the junction of the first inflatable bed 100 and the rear chamber 500.

The second end of the second inflatable bed 200 is movably connected to the junction of the first inflatable bed 100 and the front chamber 300 to form an arch.

Or, an outer side of the front chamber 300 is provided with two third rope holders. The second end of the second inflatable bed 200 is tied with the third rope holders through ropes, enabling the second inflatable bed 200 to form an arch.

Accordingly, the front chamber 300, the left chamber 400, the right chamber 600, and the rear chamber 500 all have a horizontal height higher than that of the first inflatable bed 100. Thus, the front chamber 300, the left chamber 400, the right chamber 600, and the rear chamber 500 could be used as the side of the boat.

Accordingly, outer sides of the left chamber 400 and the right chamber 600 are provided with oar holders 800 or fishing rod holders. Both of them can be used to meet the recreational use such as boating and fishing.

Accordingly, the first end of the second inflatable bed 200 is connected to the junction of the first inflatable bed 100 and the rear chamber 500 through an extension section 105. As the second inflatable bed 200 is located between the first inflatable bed 100 and the rear chamber 500, it will be squeezed, thus difficult to be bent into arch. Even the arch is made, its height will be very limited, thus bring a serious negative effect on its comfort and appearance. But by providing the extension section 105, the second inflatable bed 200 could partially and properly rid the squeezing from the first inflatable bed 100 and the rear chamber 500, avoiding the above problems coming out. Similarly, when the second inflatable bed 200 encounters strong wind or pulling and tearing from users, the properly kept squeezing strength will create a pressing effect to partially reduce the strength of the above said pulling and tearing, so to protect the welding lines between the extension section 105 and the junction of the first inflatable bed 100 and the rear chamber 500.

Specifically, to ensure the second inflatable bed 200 free of squeezing, designers have to ensure the round representing the cross section of the second tubes 201 mutually tangent to the round representing the rear chamber 500 and the first tubes 104 respectively. In other words, the length of the extension section 105 of the second inflatable bed 200 should be no less than the distance between the round center of the second tubes 201 and the round center of the rear chamber 500 and the distance between the round center of the second tubes 201 and the round center of the first tubes 104 when any two of them are tangent to each other. Considering the diameter of the rear chamber is 35 centimeters, the diameter of the second tubes 201 and the first tubes 104 is same, both are a little more than 11 centimeters, thus the distance between the round center of the rear chamber 500 and the round center of the cross section of the second tubes 201 will be no more than 23 centimeters (17.5 cm radius +5.5 cm radius); and the distance between the round center of the first tubes 104 and the round center of the cross section of the second tubes 201 will be merely a little more than 11 centimeters. To make the second inflatable bed 200 being squeezed a little, the length of the extension section 105 should be a number a little less than 11 centimeters.

Preferably, the length of the extension part is 10 cm.

Accordingly, the length of the second inflatable bed 200 is just 1.57 times of the length of the first inflatable bed 100. It is just the ratio between the length of semi-sphere and the length of diameter. This ratio guarantees the second inflatable bed 200 to form a semi-sphere arch in length. The arch-shaped second inflatable bed 200 can be used to block sun shine and to shelter the rain.

To be specific, the length of the second inflatable bed 200 is 322 cm, and the length of the first inflatable bed is 205 cm.

Accordingly, two sides of the second inflatable bed 200 are provided with a plurality of first rope holders used to tie and hang curtains. To be specific, ropes could go through the first rope holders and the eyelets on the edges of the curtains one by one to hang and fix the curtains on the second inflatable bed 200. When the second inflatable bed 200 is bent to an arch shape, hang curtains on both sides of the second inflatable bed 200 can form a private room inside/under the arch, thus meet users' needs on privacy such as swimwear change.

Therefore, the aforesaid inflatable boat could be used as an inflatable tent with curtains hanging on two sides. In addition, the curtains could be moved towards both left and right sides to open wider for better ventilation and brightness. Thus the inflatable bed could finally form an inflatable tent with a private room containing an inflated or uninflated bed inside.

To be specific, each side of the second inflatable bed 200 has two curtains hung on the rope going through the first rope holders alongside the second inflatable bed 200, any two curtains at the same side could be opened towards both left and right sides.

Figure 4:
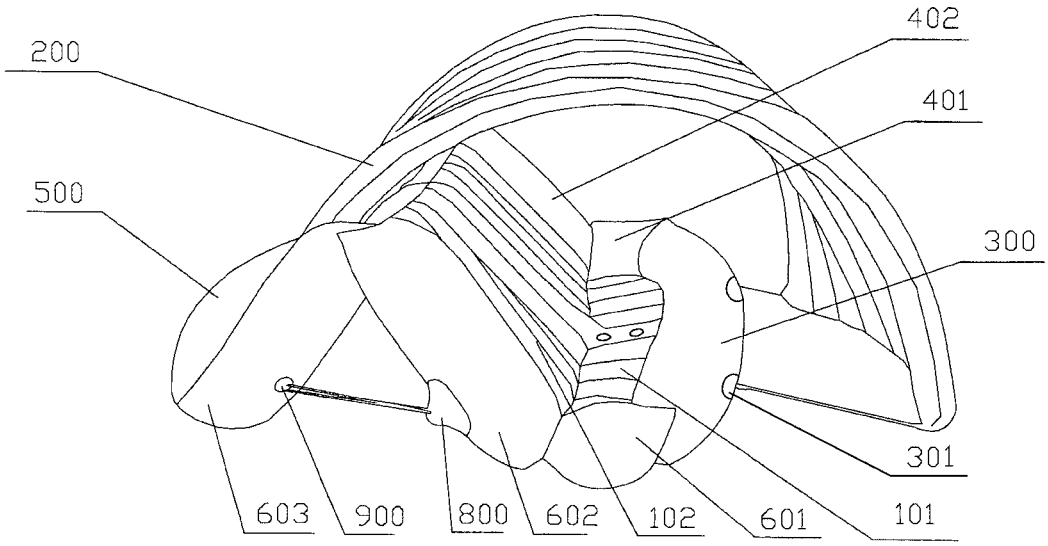
FIG. 4 is a schematic view of the inflatable recliner chair of the present invention.

As shown in FIG. 1 and FIG. 4, the inflatable recliner chair includes the first inflatable bed 100, the second inflatable bed 200, the front chamber 300, the left chamber400, the right chamber 600, and the rear chamber 500. The first inflatable bed 100 is surrounded by the front chamber 300, the left chamber 400, the right chamber 600, and the rear chamber 500. The front chamber 300, the left chamber 400, the rear chamber 500, and the right chamber 600 are connected to each other sequentially.

The first inflatable bed 100 is welded to form the first inflatable belt 101, the second inflatable belt 102, and the third inflatable belt 103. The first inflatable belt 101 is connected to the front chamber 300. The third inflatable belt 103 is connected to the rear chamber 500. The second inflatable belt 102 is located between the first inflatable belt 101 and the third inflatable belt 103.

The left chamber 400 is welded to form the first chamber 401, the second chamber 402, and the third chamber 403. The right chamber 600 is welded to form the fourth chamber 601, the fifth chamber 602, and the sixth chamber 603. The first chamber 401 and the fourth chamber 601 are located at the opposite two sides of the first inflatable belt 101. The second chamber 402 and the fifth chamber 602 are located at the opposite two sides of the second inflatable belt 102. The third chamber 403 and the sixth chamber 603 are located at the opposite two sides of the third inflatable belt 103.

Outer sides of the third chamber 403 and the sixth chamber 603 are provided with second rope holders 900 respectively. Outer sides of the second chamber 402 and the fifth chamber 602 are provided with the oar holders 800 respectively. The second rope holder 900 is tied to the oar holder 800 at the same side so as to fold the second inflatable belt 102 and the second inflatable belt 103 towards each other.

An outer side of the front chamber 300 is provided with two third rope holders 301. The second end of the second inflatable bed 200 is bent towards the front chamber 300 and tied to the third rope holders 301 through ropes, or the second end of the second inflatable bed 200 is bent and fixed by tent pegs on the ground.

The first inflatable belt 101 forms a sitting cushion, the second inflatable belt 102 forms a backrest, and the second inflatable bed 200 can block sun shine and resist rain. Thus whether to bend the second inflatable bed 200 is an option based on the weather and user favorite. The reclining degrees of the second inflatable belt 102 could be adjusted by adjusting the length of the rope linking the second rope holder 900 and the oar holder 800.

The first tubes 104 and the second tubes 201 can be bent easily as they are both ductile, a genuine merit of inflatable products utilized by this invention. In addition, once the second inflatable bed 200 is bent to an arch, reset force will be created on any position of the second inflatable bed 200. Compared with other shapes such as a triangle shape, the arch shape can create extra reset force to resist wind. The arch shape also maximizes the room under itself. Finally, the arch shape makes the whole product looks more beautiful as it breaks the domination of straight lines from the inflatable bed.

Accordingly, the first inflatable belt 101 is narrower than the second inflatable belt 102.

Accordingly, an outer side of the rear chamber 500 is provided with two fourth rope holders. Ropes and tent pegs can be used to tie on the fourth rope holders to fix the inflatable recliner chair on the ground.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A convertible inflatable device, where said convertible inflatable device can be converted to an inflatable bed, an inflatable boat, an inflatable water slide, or an inflatable recliner chair mutually and conveniently, comprising; a first inflatable bed, a second inflatable bed, a front chamber, a left chamber, a right chamber, and a rear chamber, the first inflatable bed being surrounded by the front chamber, the left chamber, the right chamber, and the rear chamber, the front chamber, the left chamber, the rear chamber, and the right chamber being connected to each other sequentially;

a first end of the second inflatable bed being pivotally and directly connected to a junction formed between the first inflatable bed and the rear chamber through an extension section;

the first inflatable bed being welded to form a first inflatable belt, a second inflatable belt, and a third inflatable belt, the first inflatable belt being connected to the front chamber, the third inflatable belt being connected to the rear chamber, the second inflatable belt being located between the first inflatable belt and the third inflatable belt;

the left chamber being welded to form a first chamber, a second chamber, and a third chamber, the right chamber being welded to form a fourth chamber, a fifth chamber, and a sixth chamber, the first chamber and the fourth chamber being located at opposite two sides of the first inflatable belt, the second chamber and the fifth chamber being located at opposite two sides of the second inflatable belt, the third chamber and the sixth chamber being located at opposite two sides of the third inflatable belt.

2. The convertible inflatable device as claimed in claim 1, wherein the front chamber, the left chamber, the right chamber, and the rear chamber each have a vertical height higher than that of the first inflatable bed.

3. The convertible inflatable device as claimed in claim 1, wherein the first inflatable bed is welded vertically to form a plurality of first tubes, the plurality of first tubes communicate with one another; the second inflatable bed is welded vertically to form a plurality of second tubes, and the plurality of second tubes communicate with one another.

4. The convertible inflatable device as claimed in claim 1, further comprising a water-spraying hose, the water-spraying hose having a plurality of water-spraying holes thereon, one end of the water-spraying hose being disposed on the first inflatable bed, another end of the water-spraying hose being extended beyond a second end of the second inflatable bed;

the water-spraying holes being grouped in two, located on two sides of the water-spraying hose;

the water-spraying hose being centered on the first inflatable bed and the second inflatable bed.

5. The convertible inflatable device as claimed in claim 1, wherein a second end of the second inflatable bed is movably connected to a junction of the first inflatable bed and the front chamber, so that the second inflatable bed is bent to form an arch.

6. The convertible inflatable device as claimed in claim 1, wherein an outer side of the front chamber is provided with two third rope holders, a second end of the second inflatable bed is tied with the third rope holders through ropes, enabling the second inflatable bed to form an arch.

7. The convertible inflatable device as claimed in claim 6, wherein outer sides of the left chamber and the right chamber are provided with oar holders or fishing rod holders.

8. The convertible inflatable device as claimed in claim 7, wherein two sides of the second inflatable bed are provided with a plurality of first rope holders used to tie and hang curtains.

9. The convertible inflatable device as claimed in claim 1, wherein outer sides of the third chamber and the sixth chamber are provided with second rope holders respectively, outer sides of the second chamber and the fifth chamber are provided with oar holders respectively, the second rope holder is tied to the oar holder at the same side so as to fold the second inflatable belt and the third inflatable belt towards each other;

an outer side of the front chamber is provided with two third rope holders, and a second end of the second inflatable bed is bent towards the front chamber and tied to the third rope holders through ropes.

* * * * *